US010551052B2

(12) United States Patent
Beyer

(10) Patent No.: US 10,551,052 B2
(45) Date of Patent: Feb. 4, 2020

(54) LIGHTING SYSTEM WITH INTEGRATED SMOKE DETECTOR

(71) Applicant: Peter Ernest Beyer, Helena Valley (AU)

(72) Inventor: Peter Ernest Beyer, Helena Valley (AU)

( * ) Notice: Subject to any disclaimer, the term of this patent is extended or adjusted under 35 U.S.C. 154(b) by 0 days.

(21) Appl. No.: 15/810,541

(22) Filed: Nov. 13, 2017

(65) Prior Publication Data

US 2018/0128478 A1 May 10, 2018

Related U.S. Application Data

(63) Continuation of application No. PCT/AU2016/050350, filed on May 10, 2016.

(30) Foreign Application Priority Data

May 13, 2015 (AU) ..... 2015901736

(51) Int. Cl.

| | |
|---|---|
| ***G08B 17/10*** | (2006.01) |
| ***F21V 33/00*** | (2006.01) |
| ***F21S 9/02*** | (2006.01) |
| ***F21V 23/06*** | (2006.01) |
| ***H01R 33/945*** | (2006.01) |

(52) U.S. Cl.

CPC ..... *F21V 33/0076* (2013.01); *F21S 9/022* (2013.01); *F21V 23/06* (2013.01); *G08B 17/10* (2013.01); *H01R 33/9453* (2013.01)

(58) Field of Classification Search

CPC ..... F21V 33/0076; F21K 9/23; G08B 21/14; G08B 17/103

See application file for complete search history.

(56) References Cited

U.S. PATENT DOCUMENTS

| | | | | |
|---|---|---|---|---|
| 4,090,178 | A * | 5/1978 | Norris | F21V 33/0076 340/506 |
| 4,504,960 | A | 3/1985 | Yamada | |
| 4,635,040 | A * | 1/1987 | Masot | G08B 25/06 340/531 |
| 4,812,827 | A * | 3/1989 | Scripps | G08B 17/00 340/586 |
| 4,980,672 | A | 12/1990 | Murphy | |
| 5,432,500 | A | 7/1995 | Scripps | |
| 5,481,452 | A * | 1/1996 | Simmons | G04G 15/006 307/141 |
| 5,705,979 | A * | 1/1998 | Fierro | G08B 25/04 340/506 |
| 6,426,703 | B1 * | 7/2002 | Johnston | G01N 33/004 340/628 |
| 7,504,960 | B2 * | 3/2009 | McGrath | G08B 17/10 340/286.05 |

(Continued)

OTHER PUBLICATIONS

International Search Report, PCT/AU2016/050350, dated Aug. 25, 2016, 7 pages.

(Continued)

*Primary Examiner* — Toan N Pham

(74) *Attorney, Agent, or Firm* — Edell, Shapiro & Finnan, LLC

(57) ABSTRACT

A lighting system made up of a smoke detector including a detector, a power source, alarm and control means, and a light socket. At least the detector is integrated into the light socket.

12 Claims, 5 Drawing Sheets

(56) References Cited

U.S. PATENT DOCUMENTS

| | | | | |
|---|---|---|---|---|
| 7,786,879 | B2 | 8/2010 | Lax | |
| 8,084,700 | B1 * | 12/2011 | Massaro | H01H 3/26 200/38 R |
| 8,519,566 | B2 | 8/2013 | Recker et al. | |
| 9,208,676 | B2 * | 12/2015 | Fadell | G05B 19/042 |
| 9,589,461 | B1 * | 3/2017 | Byrne | G08C 19/00 |
| 9,800,429 | B2 * | 10/2017 | Crayford | H04L 12/2803 |
| 2005/0099312 | A1 | 5/2005 | Blanche | |
| 2014/0266747 | A1 * | 9/2014 | Prendergast | G08B 17/10 340/628 |
| 2015/0077243 | A1 * | 3/2015 | Hooper | H02H 3/16 340/532 |

OTHER PUBLICATIONS

Written Opinion of the International Searching Authority, dated Aug. 25, 2016, 5 pages.

* cited by examiner

LIGHTING SYSTEM WITH INTEGRATED SMOKE DETECTOR

FIELD OF THE INVENTION

The invention relates to a lighting system with integrated smoke detector. The invention is particularly suited to integrating a smoke detector into a light socket to which stylised lights can be attached or into a stylised light fitting.

BACKGROUND

The following discussion of the background to the invention is intended to facilitate an understanding of the present invention. However, it should be appreciated that the discussion is not an acknowledgment or admission that any of the material referred to was published, known or part of the common general knowledge in any jurisdiction as at the priority date of the application.

A number of jurisdictions now require buildings to install smoke alarms for the protection of occupants. However, the utilitarian nature of smoke detectors has resulted in them taking on utilitarian forms. In a lot of cases this poses no issue, but in some buildings proper placement of such smoke detectors adversely impacts the general aesthetics of the building.

One way to overcome this problem is to stylise the smoke detector housing. However, with a wide variety of aesthetic styles, the economics of producing stylised smoke detectors is limited. This solution does not resolve the problem for consumers who seek a minimal aesthetic.

It is therefore an object of the present invention to create a light socket or fitting with integrated smoke detector that allows for the integrated unit to either itself be stylised or be disguised by the fitted light.

SUMMARY OF THE INVENTION

Throughout this document, unless otherwise indicated to the contrary, the terms "comprising", "consisting of", and the like, are to be construed as non-exhaustive, or in other words, as meaning "including, but not limited to".

In accordance with a first aspect of the present invention there is a lighting system comprising:

a smoke detector comprising detector, a power source, alarm and control means; and a light socket, where at least the detector is integrated into the light socket.

The light socket may itself be integrated into a light fitting. Alternatively, the light socket may include retaining means, the retaining means operable to facilitate integration of a light fitting to the light socket.

Preferably, the light socket is controlled by way of a wall switch, the wall switch also incorporating the control means. In this respect, ideally, the control means includes a set of switches, the set of switches including at least one of the following: a test switch; a reset switch; a combined test and reset switch.

The wall switch may also include a battery housing, the battery housing operable to receive the power source. The wall switch may incorporate an external face and the battery housing is accessible by way of the external face without need for removal of the wall switch.

The wall switch may also include the alarm. The alarm may be any of the following: an audible alarm; a visual alarm; an audio-visual alarm.

The wall switch may control a plurality of light sockets.

A single cable may be used to provide control signals provided by way of the wall switch to the lighting system and power to the smoke detector.

Preferably, the light socket incorporates a plurality of vent holes, the vent holes operable to allow air to enter the light socket and circulate about the detector.

The control means may form part of a detachable control panel. The control panel may take the form of a touch screen display and the set of switches are represented by virtual buttons on the touch screen display. The control panel may also incorporate processing means, the processing means operable to provide at least one or more of the following functions: a reminder to occupants to test the smoke detector; a reminder to occupants to replace the power means; a visual determination of the amount of power left in the power means.

A light source installed in the light socket may be configured to draw power from the power source in the event of failure of mains power. Similarly, the lighting system may include an emergency light source, the emergency light source supplied power in the event of failure of mains power supply to the light socket.

The battery housing may also operate to recharge the power means.

BRIEF DESCRIPTION OF THE DRAWINGS

The invention will now be described, by way of example only, with reference to the accompanying drawings, in which.

DETAILED DESCRIPTION

Figure 1B:
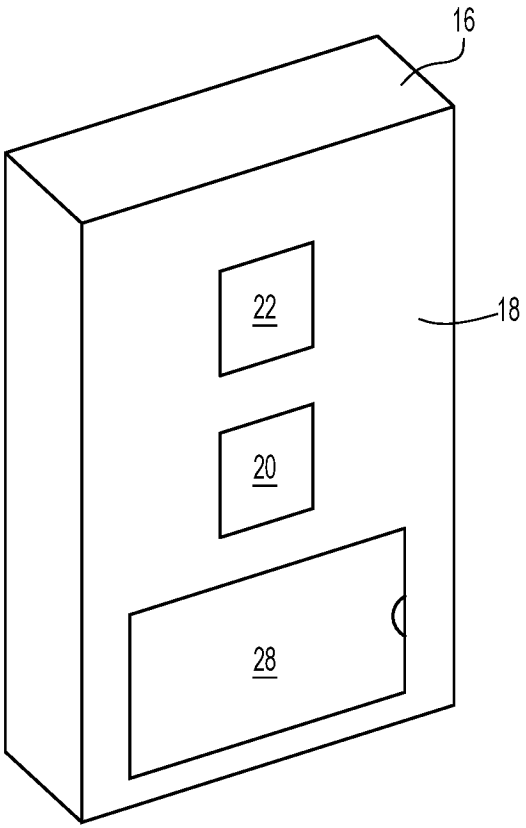
FIGS. 1A and 1B show front and rear isometric views of a control panel as used in a lighting system according to a first embodiment of the invention.
Figure 1A:
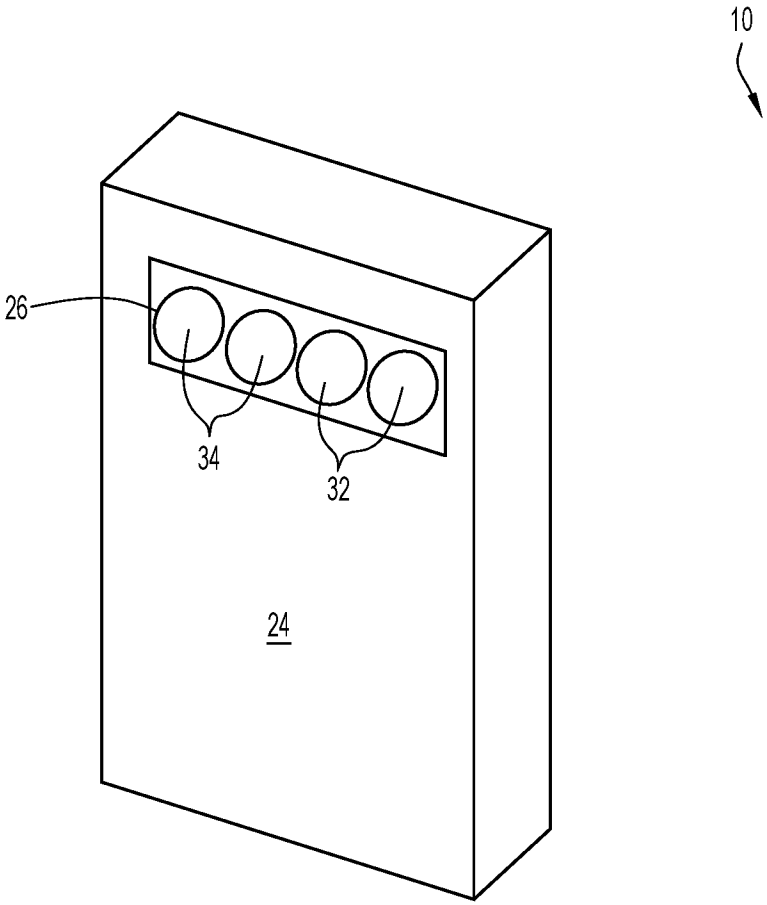
Figure 2:
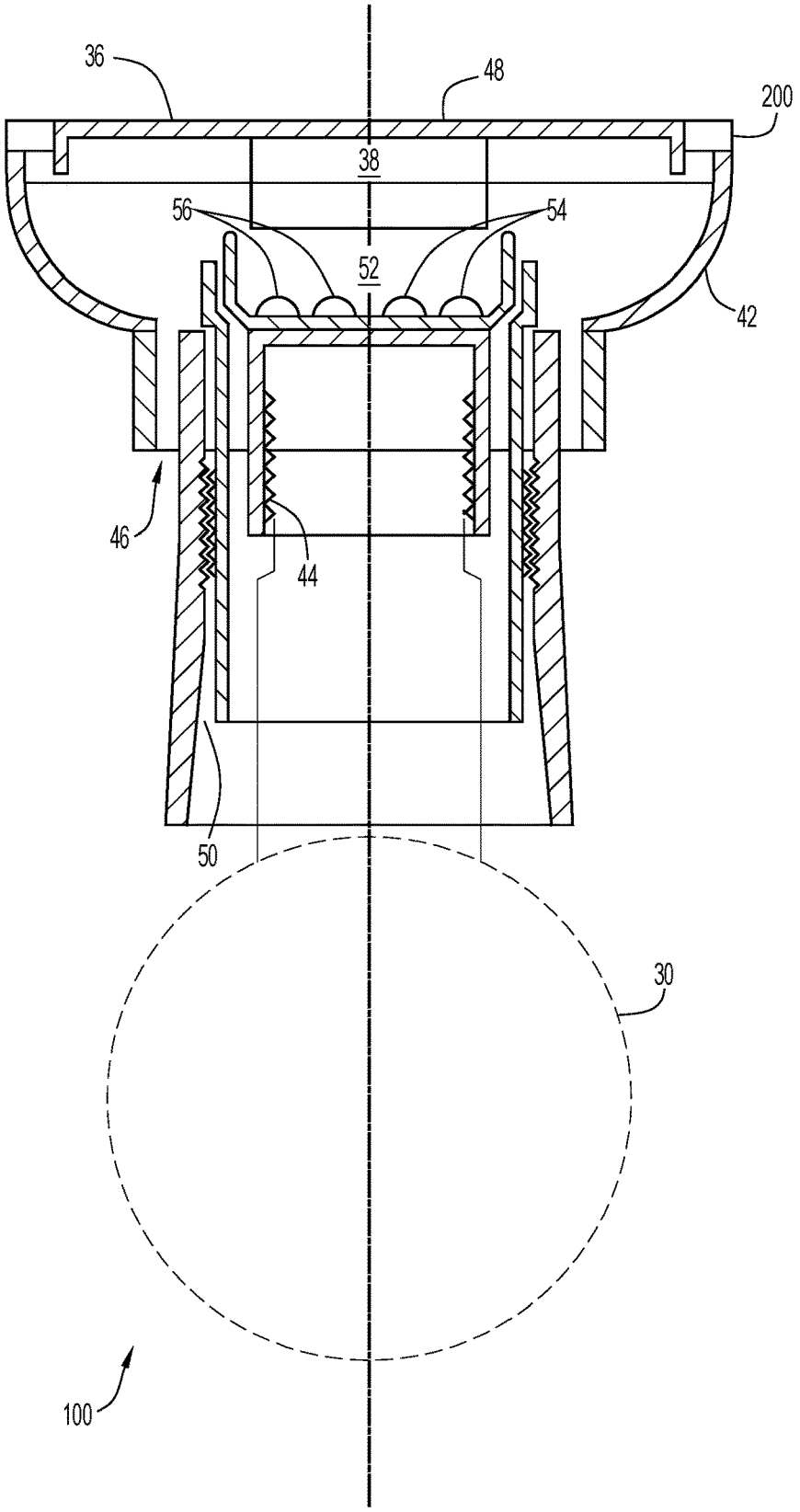
FIG. 2 is a plan cross-sectional view of a light socket as used in the lighting system as shown in FIGS. 1A and 1B.
Figure 3:
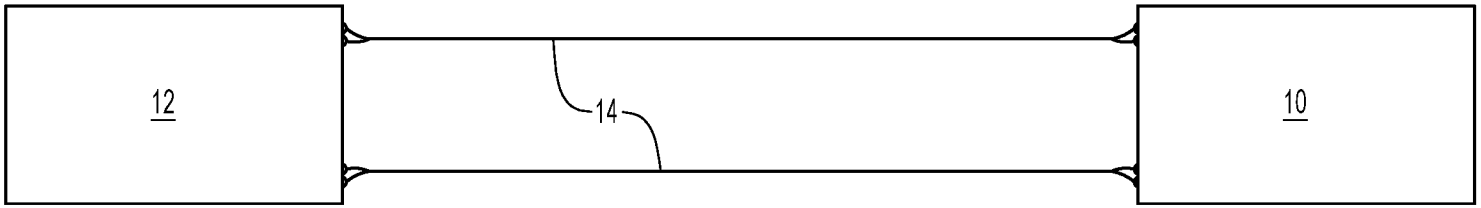
FIG. 3 is a wiring schematic of a lighting system as shown in FIGS. 1A and 1B.
Figure 6:
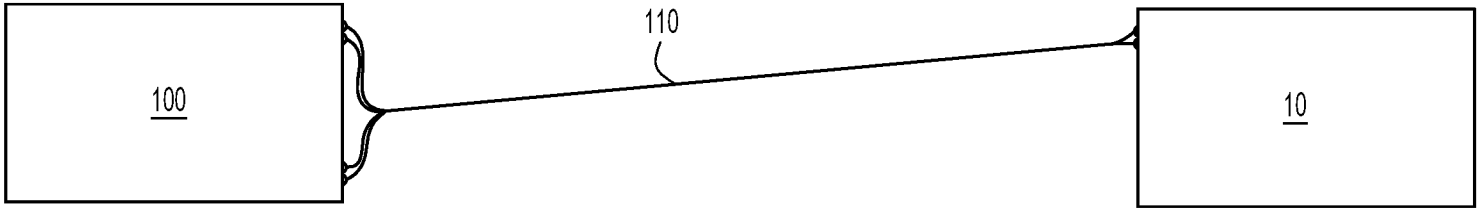
FIG. 6 is a wiring schematic of a lighting system as shown in FIG. 4.
Figure 4:
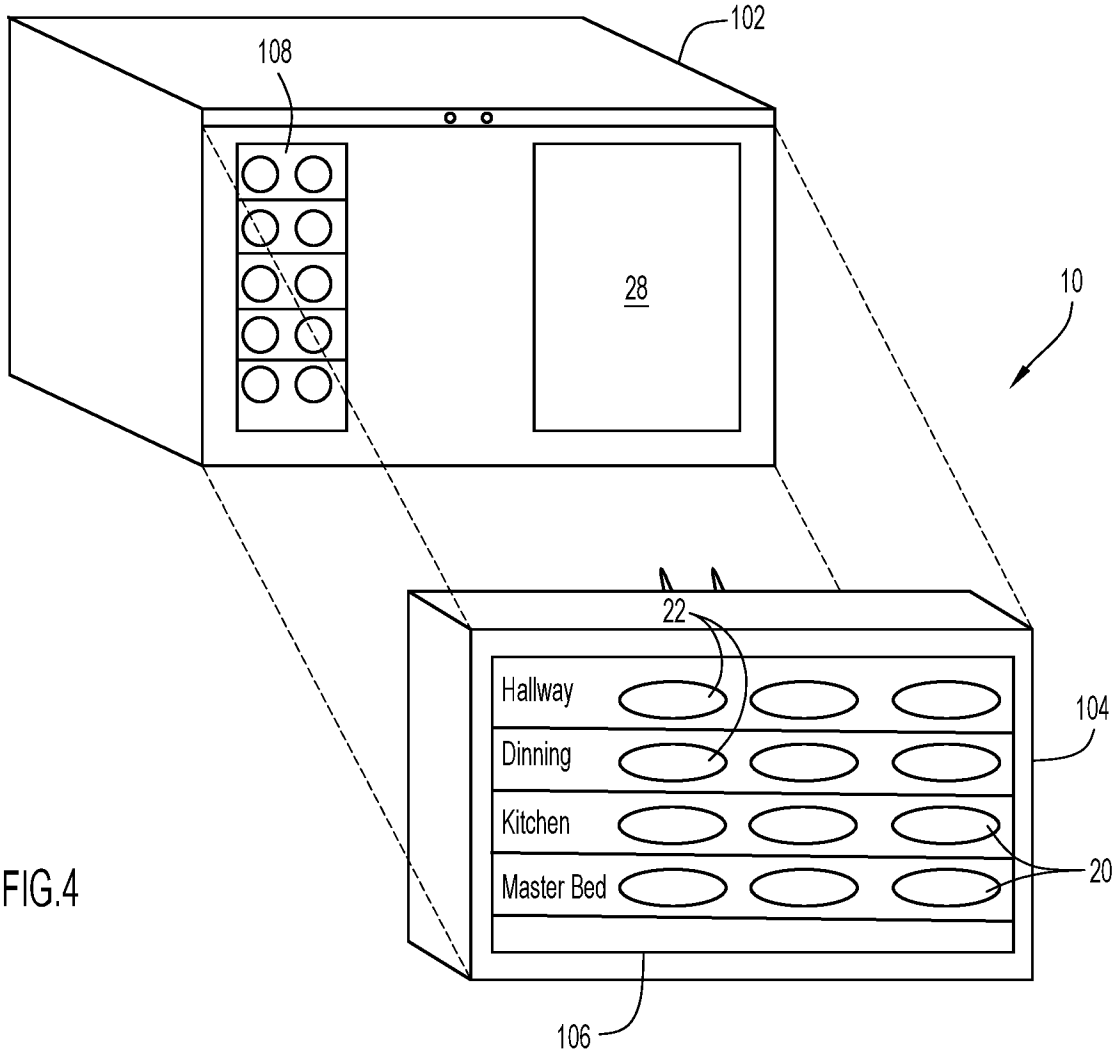
FIG. 4 is an exploded front view of a control panel as used in a lighting system according to a second embodiment of the invention.

In accordance with a first embodiment of the invention there is a lighting system comprising a control panel 10 and a light socket 12. The control panel 10 is connected to the light socket 12 by way of at least one cable 14.

In this embodiment the control panel 10 takes the form of a wall plate 16. An external facing side 18 of the wall plate 16 has a press button switch 20 and a toggle switch 22. An internal facing side 24 has connection points 26 for the at least one cable 14 and a battery housing 28.

The press button switch 20 operates as a test/reset switch as will be described in more detail below. The toggle switch 22 operates to turn on or turn off a light source or light sources 30 connected to the light socket 12.

In this embodiment, the connection points 26 comprise a set of electrical connection points 32 and a set of control communication points 34.

The light socket 12 comprises a housing 36 and detector 38. The housing 36 houses the detector 38 in a manner that the detector 38 is not externally visible.

The detector 38 operates to detect smoke or other indicators in the air that are suggestive of fire by way of photosensitive means as would be known to the person skilled in the art. The detector 38 further incorporates an audible siren (not shown) which is activated when the photosensitive means detects an indicator of fire in the air or when the detector 38 is being tested.

In this embodiment, the housing 36 has an open-ended cylindrical segment 40 protruding from a base mount 42. The open-ended cylindrical segment 40 has a threaded internal profile 44. The threaded internal profile 44 is of size and structure as to match a threaded profile of a light globe (not shown) as would be readily known to the person skilled in the art.

A plurality of apertures 46 are provided in the base mount 42 at equidistant positions around the open-ended cylindrical segment 40. The apertures 46 allows air to enter the housing 36 and circulate about the detector 38 before exiting the housing 36.

The base mount 42 also has ceiling fixing means 48 and retaining means 50. In this embodiment the ceiling fixing means 48 take the form of clips (not shown). When the base mount 42 is received within a hole of suitable size and shape within the ceiling (also not shown), the clips operate to releasably clamp the light socket 12 to adjacent portions of the ceiling.

The retaining means 50 can take a variety of forms as would be readily known to the person skilled in the art. However, the function of the retaining means 50 is to allow a light fitting (not shown) to be installed relative to the light socket 12 in a manner that disguises the light socket 12 while not impeding on the light socket's secondary function as a smoke detector.

The light socket 12 further comprises connection points 52 in the form of a set of electrical connection points 54 and a set of control communication points 56. A cable 14*a* extends from electrical connection points 54 to electrical communication points 32. In this manner, electrical power provided by a battery installed in the batter housing 28 is supplied to the detector 38.

A further cable 14*b* extends from control communications points 56 to control communication points 34.

This first embodiment of the invention will now be described in the context of its intended use.

A user (not shown) depresses press button switch 20 to determine whether the detector is still operable. Depressing the press button switch 20 sends a signal (not shown) to the detector 38 by way of cable 14*b*. This signal is interpreted as a signal intended to initiate the test procedure (not shown) provided for in the detector 38.

For the purposes of this example, it will be presumed that a battery (not shown) has not been installed in battery housing 28. Without electrical power being supplied to the detector 38, the test procedure provided for in the detector 38 is not initiated and thus no audible alarm is activated.

The lack of audible alarm indicates to the user that either the detector 38 is unpowered or that there is a fault in the detector 38.

To determine which of these situations is correct, the user checks the battery housing 28 by removing its cover. In this case, this inspection shows that there is no battery in the battery housing 28 and as a result the fault relates to the detector 38 being unpowered.

The user than acquires a battery of appropriate size, shape and voltage and installs the battery in the battery housing and thereafter replaces the wall plate 16. Installation of the battery now provides power to the detector by way of cable 14*a*.

The user can then continue to go about their business as per normal. If the user requires the light associated with the detector 38 to be turned off or on at any time, the user sets the toggle switch 22 to the appropriate setting.

To further illustrate the invention, at a later time the detector 38 initiates an audible alarm on the false detection of a fire. Once the user has confirmed that there is no fire presenting a danger to occupants, the user again depresses the press button switch 20. Depressing the press button switch 20 in these circumstances sends a further signal by way of cable 14*b*. This signal is interpreted as a signal intended to reset the detector 38. Resetting the detector 38 cancels the audible alarm.

In a second embodiment of the invention where like numerals reference like parts there is a lighting system comprising a control panel 10 and a plurality of light fittings 100. The control panel 10 is connected to each light fitting 100 by way of a single cable 14.

In this embodiment the control panel 10 includes a housing 102 having a detachable external face 104. The housing 102 is adapted to be received within a wall (not shown) or other similar structure so that only the detachable external face 104 is visible.

The housing 102 incorporates the connection points 26 and the battery housing 28. It is to be noted though that in this embodiment, commands and power are provided to each light fitting 100 by way of a single cable 14 using Power over Ethernet (PoE) techniques as would be readily known to the person skilled in the art. Thus, while there are only a single set of connection points 26 for each light fitting 100, due to the control panel 10 controlling multiple light fittings 100, the control panel 100 still incorporates multiple sets of connection points 26.

In this embodiment, the detachable external face 104 comprises a touch screen display 106. The role of the touch screen display 106 will be described in more detail below.

Each light fitting 100 is in essence of identical construction to the light socket 12 of the first embodiment with the exception of the omission of the retaining means 50. As the functional elements of the light socket form an integral part of the stylised light fitting 100 the retaining means is not required.

Similar to the connection points 26 of the control panel 10, each light fitting also includes a single set of connection points 108. The single cable connecting the connection points 26 to connection points 108 takes the form of a PoE cable 110.

In a further variant of light fittings 100 relative to the light socket 12 of the first embodiment of the invention:

the detector 38 of each light fitting 100 receives mains power as well as power from the battery (not shown) installed in the battery housing 28.

Light source 112 is operable to receive power from the battery (not shown) installed in the battery housing 28 in the event of failure of mains power.

This second embodiment of the invention will now be described in the context of its intended use.

A user detaches the detachable external face 104 from the remainder of the housing 102. Removal of the detachable external face 104 in this manner provides the user with easy access to the battery housing 28. In particular, it provides the user with easy access to the battery (not shown) in a manner that facilitates ease of the battery's removal or installation.

In this example, the user acts to install a battery of appropriate size, shape and voltage into the battery housing. It is to be noted that in this embodiment the battery may need to be specialised so as to provide sufficient electrical power to all light fittings 100 connected by way of a connection point 26.

Once the battery is installed, the user reattaches the detachable external face 104 to the housing 102 and operates to turn on the touch screen display 106.

Turning on the touch screen display 106 provides the user with a set of virtual buttons 108 for each connected light fitting 100. The set of virtual buttons 108 comprises:

a power button for the light source 112 associated with the light fitting 100;

a cancellation button for the detector 38; and a test button for the detector 38.

Pressing on the power button for the light source sends a control signal along PoE cable 110 which, when received by the light fitting 100, is interpreted as a toggle of the present powered state of the light source 112. This arrangement would be readily apparent to the person skilled in the art.

Pressing the cancellation button sends a similar control signal along PoE cable 110 which, when received by the light fitting 100, operates to cancel any audible alarm emitted by the detector 38 installed in the relevant light fitting 100.

Pressing the test button sends a control signal along PoE cable 110 which, when received by the light fitting 100, operates to switch the draw of electrical power for both the detector 38 and the light source 110 from the mains power supply to the battery installed in the battery housing 28. On completing the switch, the detector 38 operates to initiate the test procedure (not shown) provided for in the detector 38. At the same time, the light source is set to a powered state.

This means that in the event of a successful test, not only should an audible alarm be emitted from the detector 38, but the light source 110 should also be emitting light. A partial failure of the test illustrates to the user that a component may be malfunctioning for reasons not attributable to a lack of battery power. A full failure of the test similarly suggests to the user that the battery installed in the battery housing 28 may no longer hold any charge.

Once the test has been completed, the light fitting operates to switch back the draw of electrical power for both the detector 38 and the light source 110 to the mains power supply.

It is to be noted that in both embodiments the inclusion of the battery and press button switch 20 within the wall plate 16 makes things more convenient for the user than having these elements forming part of the wall socket (or a separate smoke detector as is presently the case). Particularly so in situations where the light socket 12 is attached to a raked ceiling or otherwise positioned at a height beyond that that could be normally reached by a person where a ladder or actuator (such as a broom handle) may need to be used to cancel false alarms or allow access to the detector 38 power supply. This convenience may prompt the user to test the detecting means 38 more often and, if the test shows that the battery is no longer supplying power, also facilitate quick and easy battery replacement.

Furthermore it is to be noted that there is a benefit to configuring the light socket or light fitting such that the detector 38 is, when installed, located directly above the light source. This benefit takes the form of an increase in air flow about and to the detector 38 caused by heat generated by the light source.

Finally, the integration of the smoke alarm with a light socket or light fitting removes the need for a separate electrical wiring system for smoke alarms. This results in a cost saving to the occupant or building owner which—when combined with the ability to mask the smoke alarm within the stylised form of the installed lighting systems—may encourage installation of more smoke detectors. This then leads to the increased potential to identify a fire at a time when it does not pose a significant safety threat to building occupiers.

It should be appreciated by the person skilled in the art that the above invention is not limited to the embodiments described. In particular, the following modifications and improvements may be made without departing from the scope of the present invention:

The light socket 12 may take the form of a batten fitting as would be readily known to the person skilled in the art.

The internal profile of the open-ended cylindrical segment 40 may take other forms that allow for releasable retention of a light globe. For instance, the open-ended cylindrical segment 40 may have an internal profile to allow for the releasable retention of a bayonet-style light globe as would be readily known to the person skilled in the art.

While the invention has been described in the context of a light socket or light fitting adapted to be user with a light globe, the invention is not limited to such use. The invention can easily be adapted for use with other light sources, such as incandescent, fluorescent, halogen and light-emitting diode based light sources.

The fixing means 44 may take any form of arrangement as would be readily apparent to the person skilled in the art. For instance, the fixing means may take the form of screw, friction or hook fixings.

While the above embodiments have been described with the detector 39 incorporating the audible siren, the audible siren may just as easily be incorporated into the control panel 12. Doing so reduces the number of components needed to be incorporated into the light socket or light fitting which facilitates ease of styling, but may not be appropriate in situations where the control panel 12 is some distance from the area which triggers the alarm.

Apertures 46 preferably take the form of perforations, slots or other forms that disguise their intended function.

The control panel 12 may incorporate a visual alarm in the case of fire in addition to the audible alarm or as an alternative thereto. If the visual alarm takes the form of the light source, ideally the light source is turned on and off in a set pattern to differentiate an alarm condition form its ordinary operation.

It is to be noted that in the first embodiment, installation of the light fitting by way of retaining means 50 may occur either at the time of installation of the light socket or subsequent. Furthermore, it is the intent of the invention that the retaining means 50 be such that the installation of the light fitting may be achieved without the need of the assistance of an electrical professional.

The detachable front face 104 may be omitted in favour of an arrangement whereby a face of the housing may be manipulated to a position which allows ease of access to the battery housing 28 as described above. Alternatively, the battery housing 28 may form part of a separate arrangement which facilitates the ease of access as already described, e.g. by incorporating the battery housing 28 into a separate drawer system.

The control panel 10 may use other control mechanisms to those described and include yet further control systems. For instance, controls may be added to operate differing lighting patterns in situations where there are multiple light sources controlled off a single light fitting or light socket. A further option is to install switches that control the intensity of the light sources controlled off the single light fitting or light source (i.e. dimmer switches).

While the above embodiments have been described in the context of the light socket or light fitting being designed for mounting to a ceiling, there is no reason why the invention cannot be used in relation to light sockets or light fittings designed for mounting to a wall or other building structure which would otherwise normally be used to mount a light source.

Figure 5:
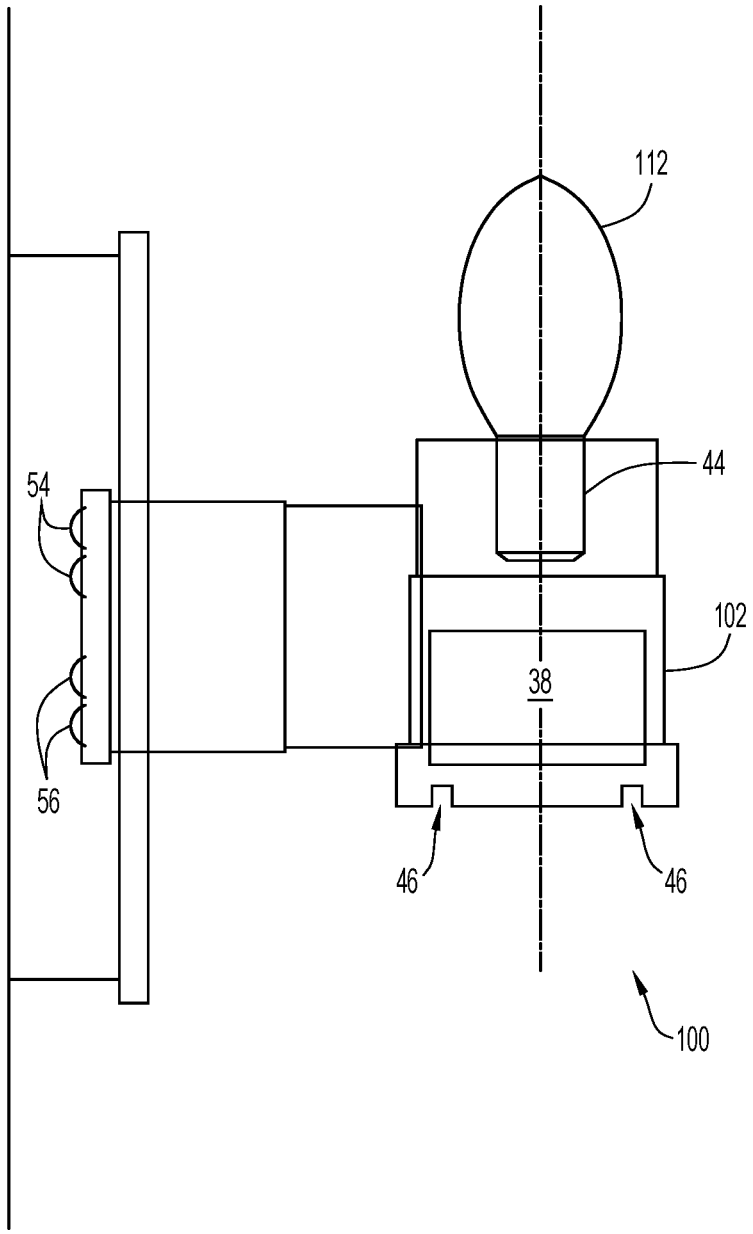
FIG. 5 is a plan cross-sectional view of a light fitting as used in the lighting system as shown in FIG. 4.

To ensure proper air flow around the detector 38, the light socket 12 or light fitting 100, as appropriate, may be provided with vent holes 200 as shown in FIG. 5. The vent holes 200 may operate to vent air either into the ceiling space or back into the surrounding atmosphere but in a direction through and away from the detector 38.

The touch screen display 106 may be imbued with additional functional processing requirements that allow it to perform additional functions, such as issue a reminder to occupants to test one or more of the detecting means 38 or to display the amount of power left in the battery installed in the battery housing 28.

The battery housing 28 may also incorporate circuitry that allow for recharging of any battery installed therein.

The battery housing 28 may be directly accessible by way of the external face 18 of the wall plate 16. Alternatively, the wall plate 16 may need to be removed in order to access the battery housing 28.

In a variation of the second embodiment, an additional light source in the form of an LED emergency light may be incorporated into the light fitting 100. In such a configuration, on failure of the mains power supply due to an emergency situation as detected by way of detector 38, the battery installed in the battery housing 38 may power the LED emergency light instead of the light source 112.

The detecting means 38 may take the form of an ionisation detector or other form of means for detection of a fire or symptoms of a fire. The detecting means 38 may also incorporate other means for detecting emergency situations, such as high levels of carbon monoxide.

It should be further appreciated by the person skilled in the art that the invention is not limited to the embodiments described above. Additions or modifications described, where not mutually exclusive, can be combined to form yet further embodiments that are considered to be within the scope of the present invention.

What is claimed:

1. A lighting system comprising:

a smoke detector comprising a detector to detect a presence of smoke, an alarm, control means to control operation of the detector and the alarm, and a power source to provide power to the detector, the alarm and the control means; and a light socket that is fixedly connected to a surface, the surface being a wall or a ceiling, wherein the detector is integrated into the light socket without obstructing the ability of the light socket to directly receive a separate removable light source, and the control means is incorporated into a wall switch, the wall switch also being operable to control the supply of main power to the light socket.

2. The lighting system of claim 1, wherein the light socket is itself integrated into a light fitting for fixed mounting to the surface.

3. The lighting system of claim 1, wherein the light socket includes retaining means, the retaining means operable to facilitate removable attachment of a separate light fitting to the light socket.

4. The lighting system of claim 1, wherein the wall switch includes a battery housing, and the battery housing is operable to receive the power source.

5. The lighting system of claim 4, wherein the wall switch has an external face and the battery housing is accessible by way of the external face without need for removal of the wall switch.

6. The lighting system of claim 4, wherein a single cable is used to provide control signals generated by the control means by way of the wall switch to the detector and power to the detector from the power source.

7. The lighting system of claim 1, wherein the wall switch includes the alarm.

8. The lighting system of claim 7, wherein the alarm is selected from the group consisting of an audible alarm, a visual alarm, and an audio-visual alarm.

9. The lighting system of claim 1, wherein the wall switch has a detachable control panel and the control means forms part of the detachable control panel.

10. The lighting system of claim 1, wherein the control means includes a set of switches, and the set of switches includes at least one switch selected from the group consisting of a test switch, a reset switch, and a combined test and reset switch.

11. The lighting system of claim 10, wherein the control means includes a touch screen display, and the set of switches are represented by virtual buttons on the touch screen display.

12. The lighting system of claim 1, wherein the control means incorporates processing means, and the processing means is operable to provide one or more of the following functions selected from the group consisting of a reminder to occupants to test the smoke detector, a reminder to occupants to replace the power means, and a visual determination of the amount of power left in the power means.

* * * * *